US007607447B1

(12) United States Patent
Han

(10) Patent No.: US 7,607,447 B1
(45) Date of Patent: Oct. 27, 2009

(54) FRAME ASSEMBLY FOR CANOPY TENT

(76) Inventor: Jae-Kab Han, 97-5, Sosabon-Dong, Sosa-Gu, Bucheon-Si, Gyeonggi-Do (KR) 442-230

( * ) Notice: Subject to any disclaimer, the term of this patent is extended or adjusted under 35 U.S.C. 154(b) by 0 days.

(21) Appl. No.: 12/314,189

(22) Filed: Dec. 5, 2008

(51) Int. Cl.
*E04H 15/28* (2006.01)

(52) U.S. Cl. ..... 135/135

(58) Field of Classification Search ..... 135/98, 135/124, 128, 135
See application file for complete search history.

(56) References Cited

U.S. PATENT DOCUMENTS

| | | | | |
|---|---|---|---|---|
| 2,227,554 | A * | 1/1941 | Riordon | 135/19.5 |
| 2,864,389 | A * | 12/1958 | Smith et al. | 135/98 |
| 3,020,555 | A * | 2/1962 | Taylor | 2/171.03 |
| 4,326,301 | A * | 4/1982 | Brock | 2/171.02 |
| 4,736,761 | A * | 4/1988 | Warfield et al. | 135/22 |
| 5,230,358 | A * | 7/1993 | Forell | 135/98 |
| 5,499,646 | A * | 3/1996 | Lee | 135/121 |
| 6,581,617 | B2 * | 6/2003 | Ham et al. | 135/135 |
| 2001/0007260 | A1 * | 7/2001 | Rousselle et al. | 135/98 |
| 2007/0051399 | A1 * | 3/2007 | Jung | 135/135 |
| 2007/0151588 | A1 * | 7/2007 | Yul et al. | 135/91 |

FOREIGN PATENT DOCUMENTS

| | | |
|---|---|---|
| KR | 20-0213389 | 7/2000 |
| KR | 20-0223717 | 12/2000 |
| KR | 20-0344232 | 12/2003 |
| KR | 20-0359030 | 5/2004 |
| KR | 10-0643157 | 10/2004 |
| KR | 10-0558356 | 3/2005 |
| KR | 10-0735013 | 5/2005 |

* cited by examiner

*Primary Examiner*—David Dunn
*Assistant Examiner*—Noah Chandler Hawk
(74) *Attorney, Agent, or Firm*—Stites & Harbison PLLC; Juan Carlos A. Marquez, Esq.

(57) ABSTRACT

The present invention discloses a frame assembly for a canopy tent. The frame assembly includes a housing unit with a through hole formed therein, a sliding unit joined to the through hole, a fixing unit immovably joined to this sliding unit, a cover unit joined to the top of the housing unit, a support unit fitted into the outer circumference of said cover unit, an upper connecting pole in which a connecting socket pivotly connected to a engage slot is formed in the upper portion, and a connecting unit one end of which is pivotly connected to the connecting socket and the other end of which is pivotly connected to the sliding unit. Such a present invention provides effects that it is easy to install the canopy tent and it is possible to prevent a finger from being caught during operation thereof and safety accidents due to collision when the fixing unit comes off.

4 Claims, 3 Drawing Sheets

【Figure 1】
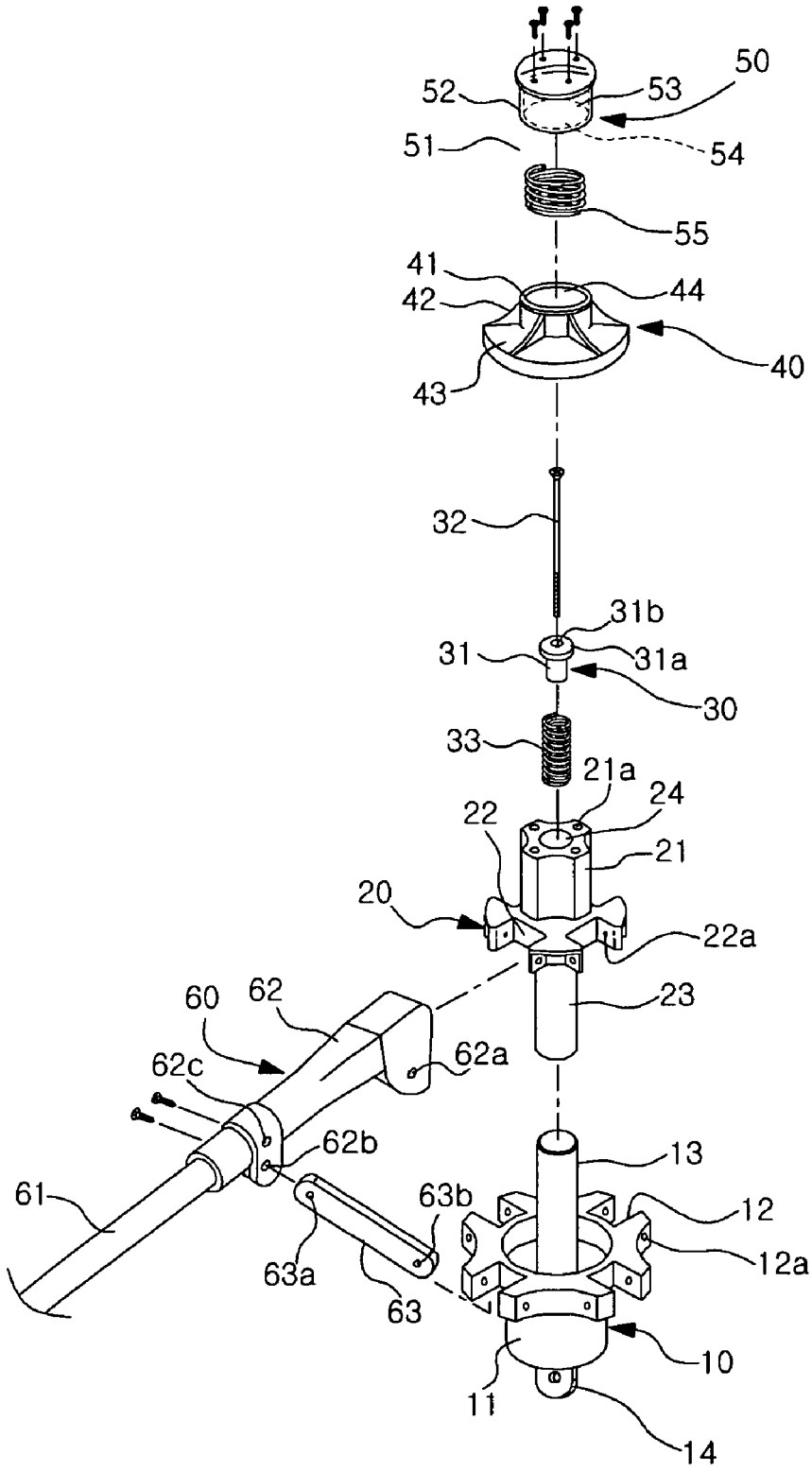

【Figure 2】
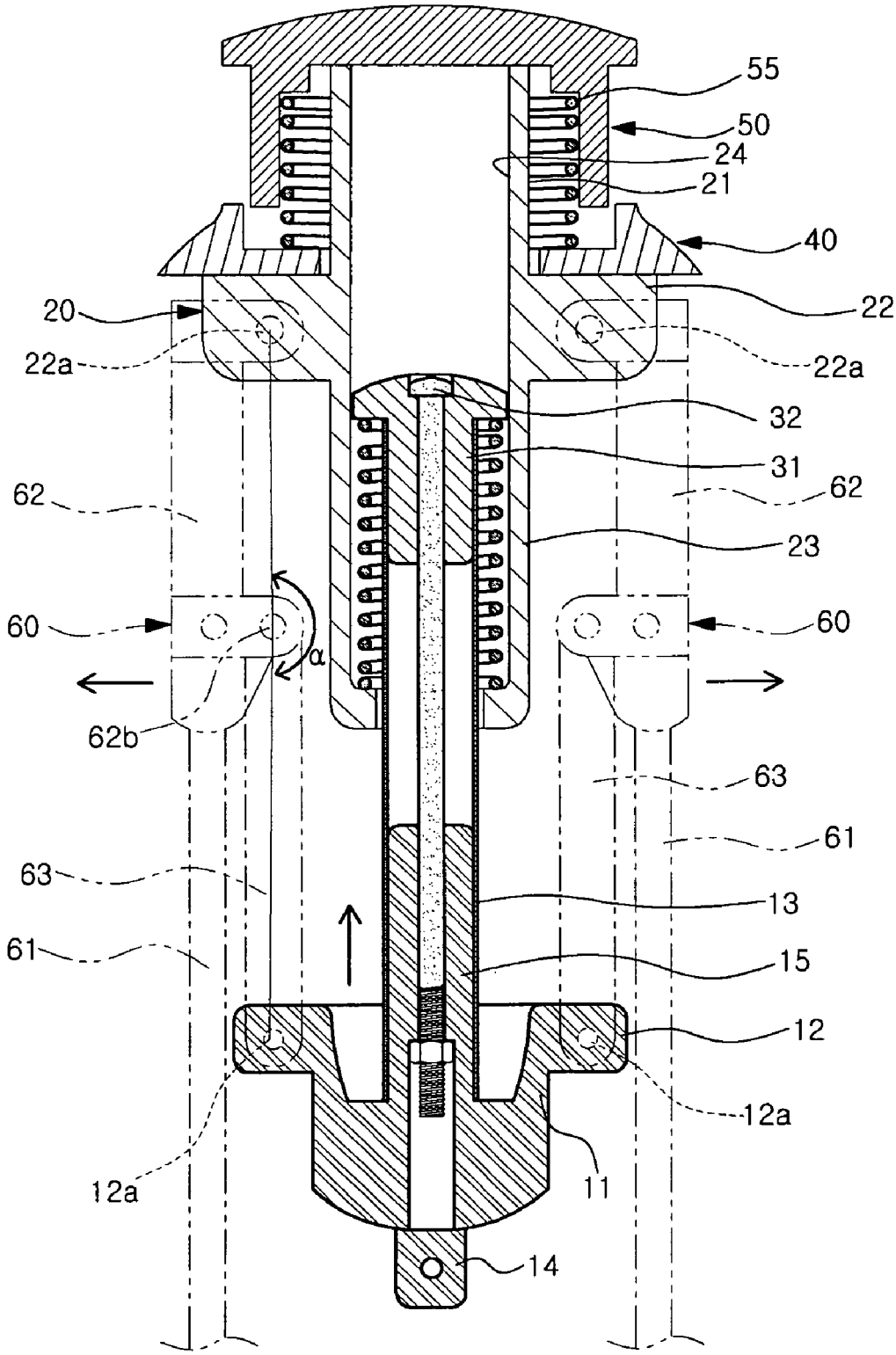

【Figure 3】
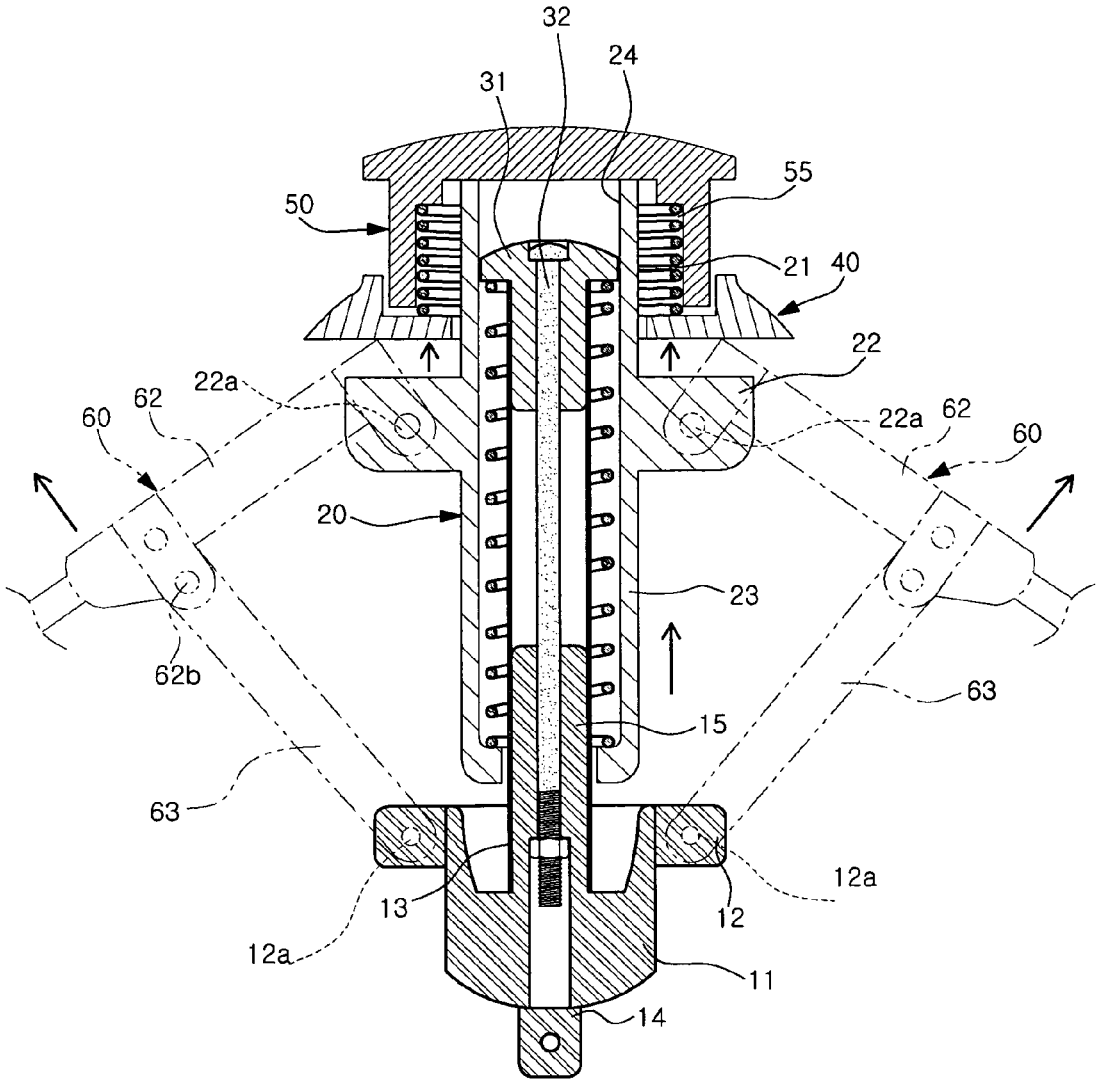

FRAME ASSEMBLY FOR CANOPY TENT

This application claims priority to Korean Patent Application No. 2008-113353, filed on Nov. 14, 2008, in the Korean Intellectual Property Office, the entire contents of which are hereby incorporated by reference.

BACKGROUND OF THE INVENTION

1. Field of the Invention

The present invention relates to a frame assembly for a canopy tent, more specifically to a canopy tent with an improved frame structure whereby it is possible to support the upper frame assembly for a canopy tent firmly and make it easy to install and dismantle the tent by making folding and unfolding easy.

2. Description of the Related Art

In general, of the various tents utilized in camping, etc., the canopy tent is widely used because it is quick and easy to install and dismantle it.

Such a canopy tent can be said to be an automatic tent that has enhanced user's convenience, since installation and dismantling are completed in a short time just by putting the tent in the place to be installed on and folding or unfolding it.

Such a conventional automatic canopy tent is disclosed in Korean Utility Model Registration Nos. 20-213389 and 20-223717, and the conventional frame assembly for a canopy tent is disclosed in Korean Utility Model Registration Nos. 20-344232 and 20-359030, Korean Patent Registration Nos. 10-558356, 10-643157, and 10-735013, etc.

In such a conventional frame assembly for the canopy tent, an upper connecting pole and a connecting unit including a connecting pole bar and connecting socket are pivotly connected in the upper portion of the frame and the upper connecting pole is rotatably installed therein, and in such a configuration the upper connecting pole is folded and unfolded.

To fold and dismantle the conventional automatic canopy tent configured as described above, the user holds the upper connecting pole located in the diagonal direction, among the upper connecting poles installed in pivotable connection to the connecting unit, and forcibly move it inward, and then the bottoms of all the upper connecting poles are moved downward to be folded.

And to unfold and install the tent that was dismantled as above, the user forcibly moves the bottom of a lower connecting pole that was bent so as to be in contact with the upper connecting pole. After that the user holds the bottom of the upper connecting pole located in the diagonal direction and forcibly moves it upward, and then all the upper connecting poles are automatically unfolded by the elastic restoration force of an elastic spring at a predetermined point of time to make it possible to install the tent.

Meanwhile, if the user presses the sliding member by applying a certain force to it at the point of time when installation is completed by unfolding the tent, the sliding member goes downward by a given length by the force transmitted by the user and the elastic force of the elastic spring.

Therefore, the outside of a support is to be located in a place higher than the height of the inside of the support connected to the sliding member to form a predetermined gradient. Accordingly the whole of the frame is in a locking state, so even if external shock energy is transmitted it is possible to maintain the state of the frame supporting the unfolded tent as it is.

However, if the tent is in a dismantled state, the support that is pivotly connected to the upper connecting pole by a hinge pin makes an inverse V shape to be inclined downward, so there is a problem that it is not so easy to install the tent initially.

In addition, at the point of time when installation is completed by unfolding the tent, the user applies a certain force to the sliding member to press it and locate the outside of the support in a place higher than the inner height of the support connected to the sliding member so as to form a predetermined gradient. Accordingly, the whole of the frame is locked, but there is a nuisance that the whole of the frame is not locked unless the user applies force one more time to the sliding member as described above to move it downward.

Another problem is that safety accidents occur frequently as the user's finger is caught between the upper connecting pole and the connecting unit during installation and dismantling of the canopy tent.

Further, the conventional tent frame disclosed in Korean Utility Model Registration No. 20-359030 has a bolt fastened below it with the center pole supported by elastic force. But in the case that it is used for a long time or the fastening of the bolt is released by external force or shock, the center pole is broken away and protruded by the elastic force of the spring. Therefore, such a conventional tent frame has a problem that the user is injured or things are damaged by collision with the center pole protruded like this.

SUMMARY OF THE INVENTION

It is an object of the present invention to provide a frame assembly for a canopy tent in which the connecting unit hinge-connected with the upper connecting pole is formed in an upward inclination, so that it is easy to install as it takes less force during the initial installation of the canopy tent, and whereby it is possible to prevent the fixing unit from coming off by providing a cover unit, and prevent safety accidents during the folding and unfolding of the upper connecting pole by providing a support unit.

In accordance with the present invention, there is provided a frame assembly for a canopy tent comprising: a housing unit having a flange with a plurality of engage slots formed therein, a engage portion and guide portion making upper and lower bodies based on the flange and a through hole formed lengthwise therein; a sliding unit having a flange with a plurality of engage slots formed therein, a cylindrical portion making a lower body based on the flange, and a support tube one end of which is inserted in a through hole of said housing unit and the other end of which is fixed to a support rod extended upward from the cylindrical portion so as to be slid along the inside of said guide portion, wherein the support rod has an insert hole formed lengthwise therein; a fixing unit having a fixing piece which is inserted into the through hole of said housing unit to be slid up and down in a state joined to the top end of the support tube of said sliding unit and has a head placed at the top end of said support tube and a fixing hole formed lengthwise therein, a joining member for fixing the fixing piece to said sliding unit, and a first elastic member installed between the head of said fixing piece and the bottom end of the guide portion of said housing unit; a cover unit which is joined to the top end of the engage portion of said housing unit so as to prevent said fixing unit from coming off and which has a cylindrical portion composing a main body and a cover having a plurality of penetrating holes formed on the rim of the main body; a support unit which is placed between the flange of said housing unit and the cover of said cover unit so as to be moved up and down by a second elastic member and has a cylindrical portion placed on the outer circumference of the cylindrical portion of said cover unit and a base plate formed at the bottom end of said cylindrical portion; an upper connecting pole pivotably joined to the said housing unit through a connecting socket, wherein said connecting socket has a first hinge hole formed at one end to be pivotly connected to a joining hole formed in the flange of said housing unit and a second hinge hole formed at the other end; and a connecting unit which has a first hinge hole formed on one end in correspondence to the second hinge hole of said connecting socket and a second hinge hole to be pivotly connected to a joining hole formed in the flange of said sliding unit, and transmits the action force of said upper connecting pole to said sliding unit, wherein the connecting socket of said upper connecting pole moves said support unit upward in close contact with said support unit during the unfolding of said upper connecting pole.

Preferrably, the inward angle $\alpha$ formed between said connecting socket and said connecting unit during the folding of said upper connecting pole is 130 to 180°.

Preferrably, a nut is fixed in the insert hole formed in the cylindrical portion of said sliding unit, and on said joining member a screw portion fastened to the nut is formed at the bottom end.

Preferrably, a plurality of fastening holes are formed in the engage portion of said housing unit and in said cover a plurality of fastening holes are formed in correspondence to said fastening holes.

According to the frame assembly for the canopy tent of the present invention, it is easy to install the tent because it takes less force than the conventional canopy tent during the installation of the tent by forming the connecting unit hinge-connected with the upper connecting pole in an upward inclination.

Also, the frame assembly for the canopy tent of the present invention is provided with a cover unit at the top end of the engage portion of the housing unit to prevent the fixing unit installed in the through hole from coming off, so it is possible to prevent accidents in which the user is injured by collision during the coming-off of the fixing unit or things from being damaged.

In addition, the frame assembly for the canopy tent of the present invention has the support unit installed between the cover unit and the housing unit, so it is possible to prevent safety accidents in which the user's finger is caught between upper connecting pole and the housing unit during the folding and unfolding of the upper connecting pole.

BRIEF DESCRIPTION OF THE DRAWINGS

These and other objects, features, and advantages of preferred embodiments of the present invention will be more fully described in the following detailed description, taken in conjunction with the accompanying drawings. In the drawings:

FIG. 1 is an exploded perspective view showing a frame assembly for a canopy tent according to one embodiment of the present invention;

FIG. 2 is a sectional view showing the folded state of the frame assembly for the canopy tent according to one embodiment of the present invention; and FIG. 3 is a sectional view showing the unfolded state of the frame assembly for the canopy tent according to one embodiment of the present invention.

DETAILED DESCRIPTION OF THE INVENTION

As shown in FIGS. 1 and 2, the frame assembly of the canopy tent of the present embodiment includes a sliding unit 10, a housing unit 20 in which the upper portion of the sliding unit 10 is slidably installed therein, a fixing unit 30 fixed to the top end of the sliding unit 10, a support unit 40 mounted on the housing unit 20, a cover unit 50 fixed to the top end of the housing unit 20, and upper connecting poles 60 and connecting units 63 to operatably connect the sliding unit 10 and the housing unit 20.

The sliding unit 10 includes a cylindrical portion 11, a plurality of engage slots 12, support tube 13, connector 14, and support rod 15.

More specially, the sliding unit 10 has a flange with the plurality of engage slots 12 formed therein, the cylindrical portion 11 making a lower body based on the flange, and the support tube 13 one end of which is inserted inside of the housing unit 20 and the other end of which is fixed to a support rod 15 extended upward from the cylindrical portion so as to be slid along the inside of the housing unit 20.

The cylindrical portion 11 composes the main body of the sliding unit 10, and has the plurality of engage slots 12 formed around the upper portion thereof, and hinge holes 12*a* formed on both sides of the engage slots 12.

The support tube 13 is a member assembled to the support rod 15 formed at the inner bottom of the cylindrical portion 11, and is extended upward of the cylindrical portion 11. The connector 14 is formed on the bottom of the cylindrical portion 11 in a ring shape for the tent cloth to be assembled and fixed. The support rod 15 is formed in protrusion on the inner bottom of the cylindrical portion 11 and the support tube 13 is fitted on the outer circumference to be assembled. An insert hole is formed inside the support rod 15 and a fastening element like a nut is fixed on the bottom portion of the insert hole.

The sliding unit 10 is slidably assembled to the bottom of the housing unit 20. The housing unit 20 includes an engage portion 21, engage slots 22, guide portion 23, and through hole 24.

More specially, the housing unit 20 has a flange with the plurality of engage slots 21 formed therein, the engage portion 21 and the guide portion 23 making upper and lower bodies based on the flange and the through hole 24 formed lengthwise therein.

The engage portion 21 having a cylindrical shape composes the top of the housing unit 20, and has a plurality of fastening holes 21*a* formed on the topside. A plurality of engage slots 22 are formed on the flange formed between the engage portion 21 and the guide portion 23, and hinge holes 22*a* are formed in both sides of the flange defining the engage slots 22.

The guide portion 23 having a cylindrical shape is formed below the flange defining the engage slots 22. In the housing unit 20 is formed a through hole 24 passing therethrough lengthwise, and in the bottom end portion is a stepped portion where the inner diameter is formed smaller than the other portions.

The fixing unit 30 is inserted into the through hole 24 to be assembled to the top end of the sliding unit 10 and supports the sliding unit 10 upwardly by elastic force. For this, the fixing unit 30 is provided with a fixing piece 31, joining member 32 and a first elastic member 33.

The stopper-shaped fixing piece 31 is provided with a head 31*a* expanded outwardly at the upper portion and a fixing hole 31*b* penetrated lengthwise therein. The joining member 32 is inserted into the fixing hole 31*b* and is formed in a bolt shape with a long length, and in the lower portion is formed a spiral portion where fixing elements such as the nut fixed below the insert hole of the support rod 15 are fastened. Therefore, with the joining member 32 inserted into the fixing hole 31*b* and the insert hole of the support rod 15, the spiral portion is fastened to the nut fixed below the insert hole to assemble the fixing unit 30 to the top of the sliding unit 10.

The first elastic member 33 is inserted into the through hole 24, and has one end seated on the bottom of the head 31*a* and the other end supported by the stepped portion formed around the bottom portion of the through hole 24. The first elastic member 33 is maintained in a compressed state during folding, which is a normal state, and it is preferable to use an extension coil spring that is stretched by elastic energy stored therein during unfolding. Therefore, during unfolding, the fixing piece 31 is pressed upward by the elastic energy stored inside during folding, so the sliding unit 10 allows it to slide upward along the inside of the housing 20 even by a small force, whereas during unfolding it provides a buffering force to prevent rapid falling by the self-weight of the related parts.

The support unit 40 is slidably fitted to the bottom end of the cover unit 50 and is supported by a spring on the flange defining the engage slot 22. The support unit 40 is provided with a cylindrical portion 41, blades 42, a base plate 43 and a guide hole 44.

The cylindrical portion 41 having a cylindrical shape composes the main body of the support unit 40. The cylindrical portion 41 includes the blades 42 formed roughly in a triangular shape around the outer circumference of the cylindrical portion 41.

The base plate 43 of a disk shape is expanded in the bottom end portion of the cylindrical portion 41. Inside the cylindrical portion 41 is formed a guide hole 44 penetrated lengthwise, and in the bottom end portion is formed a stepped portion having the inner diameter reduced to be smaller than the other portions.

The cover unit 50 is fitted to be fastened and coupled to the top of the housing unit 20 so as to close the top end of the through hole 24 to prevent the fixing piece 31 from coming off. The cover unit 50 includes a cylindrical portion 51, cover 52, penetrating holes 53, insert hole 54 and a second elastic member 55.

The cylindrical portion 51 having a cylindrical shape composes the main body of the cover unit 50. The cover 52 is formed in a stopper shape closing the top end of the cylindrical portion 51. A plurality of penetrating holes 53 are formed in the rim of the main body of the cover 52 in the same places so as to correspond to the fastening holes 51*a* of the engage portion 21 of the housing. Accordingly, the penetrating holes 53 and the fastening holes 21*a* are matched and then screw spikes are fastened in these holes to fix the cover 52 to the engage portion 21 of the housing 20.

Inside the cylindrical portion 51 is formed the insert hole 52 the bottom of which is opened and the top of which is closed by the cover 52.

The second elastic member 55 is inserted into the insert hole 54, and has one end seated on the inner circumference of the cover 52 and the other end supported by the stepped portion formed around the bottom portion of the insert hole 54. In this case it is preferable to use a compressed coil spring of such a type that the second elastic member 55 is in a stretched pose in the normal state but it is compressed for elastic energy to be stored inside at the time of unfolding by external force. Therefore, at the time of folding, the support unit 40 is pressed downward by the elastic energy stored therein at the time of unfolding to return to the original position.

The upper connecting pole 60 is a pole one end of which is pivotly connected to the engage slot 22 of the housing unit 20 and which composes the top of the canopy tent. The upper connecting pole 60 includes a connecting pole bar 61 and connecting socket 62.

The connecting pole bar 61 is formed in a bar shape to support the top of the canopy tent, and it supports the upper portion of tent cloth immovably. And at the bottom end of such a connecting pole bar 61 are joined lateral connecting poles or various support connecting poles to compose the connecting pole of the canopy tent, and the composition of such a connecting pole is well known in the art, so specific description is omitted.

The connecting socket 62 that is fitted into the top end of the connecting pole bar 61 is provided with a first hinge hole 62*a* formed in the upper portion and a second hinge hole 62*b* and joining hole 62*c* formed in the lower portion.

The first hinge hole 62*a* is formed in correspondence to the hinge hole 22*a* formed in both sides of the flange of the housing unit 20 defining the engage slot 22. Therefore, by fastening a fastening means such as hinge or bolt to the first hinge hole 62*a* and the hinge hole 22*a*, with the upper portion of the connecting socket 62 fitted into the engage slot 22, the upper connecting pole 60 is pivotly connected to the housing unit 20.

The upper portion of the connecting socket 62 is fitted into the engage slot 22 of the housing unit 20 and is protruded in one direction pivotably. The lower portion of the connecting socket 62 has a concave hinge slot formed for the connecting socket 63 to be inserted to be pivotly connected. On both sides of such a hinge slot are formed second hinge holes 62*b*.

The joining hole 62*c* is a hole for connecting the connecting pole bar 61 and the connecting socket 62, and a fastening means such as screw spike is inserted into the joining hole 62*c* to connect and fix the connecting pole bar 61 and the connecting socket 62.

The connecting unit 63 is a member formed in a bar shape for connecting the upper connecting pole 60 and the sliding unit 10, and at one end of it is formed a first connecting hole 63*a* and at the other end is formed a second connecting hole 63*b*.

The first connecting hole 63*a* is formed so as to correspond to the second hinge hole 62*b* of the upper connecting pole 60. Therefore, by being joined to the hinge hole 12*a* and the second connecting hole 63*b* by a fastening means such as hinge, pin or bolt, with the other end portion of the connecting unit 63 fitted into the engage slot 12 of the sliding unit 10, the connecting unit 63 is pivotly connected to the sliding unit 10.

Therefore, during the folding and unfolding of the upper connecting pole 60, the support tube 13 of the sliding unit 10 is slid up or down along the inside of the housing unit 20.

It is preferable that the inward angle $\alpha$ between the connecting socket 62 and the connecting unit 63 during the folding of the upper connecting pole 60 is formed to be 130 to 180°. It is because if the inward angle $\alpha$ is smaller than 130° the upper connecting pole 60 is expanded to the main body to make the volume increase during the folding of the upper connecting pole 60, so movement and carriage become inconvenient and the unfolding action is not smooth. On the other hand, if the inward angle $\alpha$ is larger than 180°, reaction force against unfolding acts between the connecting socket 62 and the connecting unit 63 during the switch from the folding state to the unfolding state of the upper connecting pole 60, so additional operation is necessary to remove this reaction force. Therefore, not only unfolding operation is troublesome, but also it becomes difficult to accommodate the tent cloth because the space in between becomes cramped as the upper connecting pole folds.

In order to make the unfolding of the upper connecting pole 60 smoother, it is more preferable that the inward angle $\alpha$ between the connecting socket 62 and the connecting unit 63 is formed to be 180° so that unfolding is possible even by a small action force.

Also, during the unfolding of the upper connecting pole 60, the connecting socket 62 of the upper connecting pole 60 has its top end portion in close contact with the support unit 40 to make the support unit 40 move upward. Since the connecting socket 62 and the support unit 40 are in close contact at all times during unfolding, a finger being caught between the connecting socket 62 and the housing unit 20 is prevented, so safety accidents can be prevented.

Also, if the fastening of the connecting unit 32 is released from the fixing unit 30, the fixing piece 31 inserted into the through hole 24 to be supported is separated upward by the elastic force of the first elastic member 33 to pop upward from the through hole 24. In order to prevent that the user is injured or things are damaged by shock due to collision with the fixing piece 31 that was separated at this time, the cover unit 50 blocks the top end of the through hole 24, so such a safety accident can be prevented.

Below the folding and unfolding actions of the frame assembly for the canopy tent of the present embodiment will be described specifically with reference to FIGS. 2 and 3.

In the folding state of the upper connecting pole 60 shown in FIG. 2, the upper connecting pole 60 is rotated in the direction of the main body to unfold it centering on the hinge inserted into the hinge hole 22*a* of the housing unit 20, as shown in FIG. 3. Then, upward pulling force is applied to the connecting unit 63 that is pivotly connected to the other end of the connecting socket 62, so it is expanded in the horizontal direction from the vertical state. At this time, upward pulling force is also applied to the sliding unit 10 that is pivotly connected to the connecting unit 63, so the sliding unit 10 is moved upward.

At this time, the head 31*a* of the fixing piece 31 of the fixing unit 30 and the support tube 13 fixed to the support rod 15 of the sliding unit 10 makes a sliding motion guided by the housing unit 20, the upward movement of the sliding unit 10 is made smoothly. Also, by the elastic energy stored in the first elastic member 33, the sliding unit 10 can be moved upward more easily even by a small force.

Also, the top end portion of the connecting socket 62 is pivoted counterclockwise centering on the hinge to pop upward after passing the top of the flange of the housing unit 20 where the engage slot 22 is formed. The top end portion of the connecting socket 62 that was protruded like this, pushes up the bottom of the support unit 40 supported on the flange of the housing unit 20, so that the support unit 40 is moved upward in close contact with the connecting socket 62. Therefore, introduction of objects such as a user's finger between the connecting socket 62 and the housing unit 20 is prevented.

During the folding of the upper connecting pole 60, the action is the opposite of what is described above. Namely, when the user folds inward the unfolded upper connecting pole 60 while taking it down, the connecting unit 63 that is pivotly connected to the connecting socket 62 is contracted inward, while the sliding unit 10 that is pivotly connected with the connecting unit 63 is moved downward along the inside of the housing unit 20. At this time, the first elastic member 33 is compressed downward by the head 31*a* of the fixing piece 31 while resistance force is generated in the process that elastic energy is stored therein, so rapid descent of the upper connecting pole 60 and the connecting unit 63 is prevented so as to prevent safety accidents.

Since elastic energy is stored inside while the second elastic member 55 is compressed during unfolding, the support unit 40 is pressed downward by this elastic energy during folding to return it to the original position. By such up and down movement of the support unit 40, enough space is provided for the top end of the upper connecting pole 60 to pivot in the process that the upper connecting pole 60 is pivoted centering on the hinge inserted into the hinge hole 22*a* during unfolding.

Although the present invention has been described in detail reference to its presently preferred embodiment, it will be understood by those skilled in the art that various modifications and equivalents can be made without departing from the spirit and scope of the present invention, as set forth in the appended claims.

What is claimed is:

1. A frame assembly for a canopy tent comprising:

a housing unit having a flange with a plurality of engage slots formed therein, a engage portion and guide portion making upper and lower bodies based on the flange and a through hole formed lengthwise therein;

a sliding unit having a flange with a plurality of engage slots formed therein, a cylindrical portion making a lower body based on the flange, and a support tube one end of which is inserted in a through hole of said housing unit and the other end of which is fixed to a support rod extended upward from the cylindrical portion so as to be slid along the inside of said guide portion, wherein the support rod has an insert hole formed lengthwise therein;

a fixing unit having a fixing piece which is inserted into the through hole of said housing unit to be slid up and down in a state joined to the top end of the support tube of said sliding unit and has a head placed at the top end of said support tube and a fixing hole formed lengthwise therein, a joining member for fixing the fixing piece to said sliding unit, and a first elastic member installed between the head of said fixing piece and the bottom end of the guide portion of said housing unit;

a cover unit which is joined to the top end of the engage portion of said housing unit so as to prevent said fixing unit from coming off and which has a cylindrical portion composing a main body and a cover having a plurality of penetrating holes formed on the rim of the main body;

a support unit which is placed between the flange of said housing unit and the cover of said cover unit so as to be moved up and down by a second elastic member and has a cylindrical portion placed on the outer circumference of the cylindrical portion of said cover unit and a base plate formed at the bottom end of said cylindrical portion;

an upper connecting pole pivotably joined to the said housing unit through a connecting socket, wherein said connecting socket has a first hinge hole formed at one end to be pivotly connected to a joining hole formed in the flange of said housing unit and a second hinge hole formed at the other end; and a connecting unit which has a first hinge hole formed on one end in correspondence to the second hinge hole of said connecting socket and a second hinge hole to be pivotly connected to a joining hole formed in the flange of said sliding unit, and transmits the action force of said upper connecting pole to said sliding unit, wherein the connecting socket of said upper connecting pole moves said support unit upward in close contact with said support unit during the unfolding of said upper connecting pole.

2. The frame assembly according to claim 1, wherein the inward angle $\alpha$ formed between said connecting socket and said connecting unit during the folding of said upper connecting pole is 130 to 180°.

3. The frame assembly according to claim 1, wherein a nut is fixed in the insert hole formed in the cylindrical portion of said sliding unit, and on said joining member a screw portion fastened to the nut is formed at the bottom end.

4. The frame assembly according to claim 1, wherein a plurality of fastening holes are formed in the engage portion of said housing unit and in said cover a plurality of fastening holes are formed in correspondence to said fastening holes.

* * * * *